United States Patent [19]

Akagi

[11] 4,349,152

[45] Sep. 14, 1982

[54] ACCUMULATOR TYPE FUEL INJECTION APPARATUS

[75] Inventor: Jiro Akagi, Oyama, Japan

[73] Assignee: Kabushiki Kaisha Komatsu Seisakusho, Tokyo, Japan

[21] Appl. No.: 193,384

[22] Filed: Oct. 2, 1980

[51] Int. Cl.[3] ..... F02M 4/16

[52] U.S. Cl. ..... 239/96; 239/533.2

[58] Field of Search ..... 239/96, 533.2–533.12

[56] References Cited

U.S. PATENT DOCUMENTS

| | | | |
|---|---|---|---|
| 2,985,378 | 5/1961 | Falberg | 239/96 |
| 3,802,626 | 4/1974 | Regnealt | 239/96 |
| 3,913,537 | 10/1975 | Ziesche | 239/96 X |

*Primary Examiner*—Robert B. Reeves
*Assistant Examiner*—Gene A. Church
*Attorney, Agent, or Firm*—Balogh, Osann, Kramer, Dvorak, Genova & Traub

[57] ABSTRACT

A fuel injection apparatus for a diesel engine comprising a holder body having an accumulator chamber and a spring chamber, a nozzle body detachably connected to the holder body, the nozzle body having formed therein a stepped longitudinal bore, a pressure chamber intermediate the stepped longitudinal bore and an injection orifice communicating with the longitudinal bore, a check valve disposed in a passage communicating a fuel injection pump with the accumulator chamber, a solenoid-operated spool valve mounted in the accumulator chamber, a communication passage having an upper end selectively connectible with the accumulator chamber through the spool valve and a lower end being in constant communication with the pressure chamber, a needle valve fitted in the stepped longitudinal bore and movable therein, and a spring accommodated in the spring chamber for biasing the needle valve toward closing the injection orifice.

2 Claims, 1 Drawing Figure

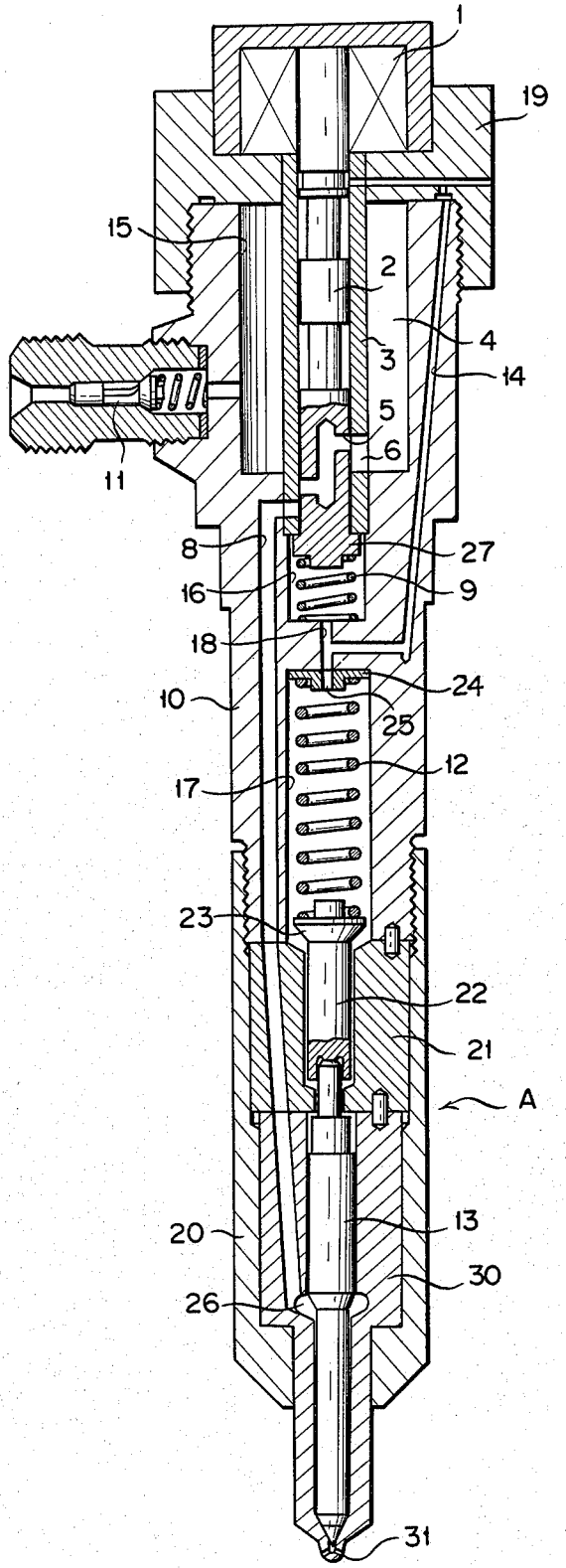
1
19
15
2
4
3
14
5
6
11
8
27
16
9
18
24
10
25
12
17
23
22
21
A
20
13
30
26
31

ACCUMULATOR TYPE FUEL INJECTION APPARATUS

BACKGROUND OF THE INVENTION

This invention relates to a fuel injection nozzle apparatus of a pressure accumulator type for use in diesel engines.

The fuel injection nozzle apparatus of the type specified which has heretofore been employed is disadvantageous in that, because the timing of beginning and termination of fuel injection is controlled by the relationship between the resilient force of the needle valve setting spring and the pressure of the fuel deliverred thereto by a fuel injection pump, the fuel kept at a pressure considerably lower than the nozzle closing pressure tends to be injected near the end of the fuel injection so that the fuel droplet will become coarse and therefore complete fuel combustion cannot be obtained.

This is due to effect of a valve located in the outlet of the fuel injection pump for preventing the occurrence of secondary fuel injection, and such phenomenon is unavoidable in the existing system wherein a high fuel injection pressure is employed.

SUMMARY OF THE INVENTION

It is therefore an object of the present invention to provide a fuel injection apparatus for a diesel engine which has overcome the above noted problems.

Another object of the present invention is to provide a fuel injection apparatus for a diesel engine which has improved injection characteristics mainly at the latter part of the injection period.

In accordance with an aspect of the present invention, there is provided a fuel injection apparatus including a fuel injection pump operatively connected therewith, comprising: a holder body having an accummulator chamber and a spring chamber formed therein at an upper end portion and a lower end portion thereof, respectively; a nozzle body detachably connected to said holder body, the nozzle body having formed therein a stepped longitudinal bore, a pressure chamber intermediate said stepped longitudinal bore and an injection orifice communicating with said longitudinal bore; a check valve disposed in a passage communicating the fuel injection pump with said accumulator chamber for allowing the fuel passage from said injection pump to the accumulator chamber but blocking the opposite way; a solenoid-operated spool valve means mounted in the accumulator chamber, the spool valve means comprising a cylindrical member having an inlet port and an outlet port formed therein and a spool movable in said cylindrical member; a communication passage formed in the holder and valve bodies, the communication passage having an upper end selectively connectible with the outlet port of the spool valve means and a lower end being in constant communication with the pressure chamber; a needle valve fitted in the stepped longitudinal bore and movable therein in response to fluid pressure developed in the pressure chamber; and a spring means accommodated in the spring chamber for biasing said needle valve toward closing the injection orifice.

The above and other objects, features and advantages of the present invention will be readily apparent from the following description taken in conjunction with the accompanying drawing.

BRIEF DESCRIPTION OF THE DRAWING

Accompanying drawing is a longitudinal cross-sectional view of a fuel injection apparatus according to the present invention.

DETAILED DESCRIPTION OF THE PREFERRED EMBODIMENT

The present invention will now be described by way of example only with reference to the accompanying drawing.

In the drawing, reference numeral 10 denotes a holder body which comprises a hollow portion or bore 15 formed in the upper part thereof, an insert hole 16 connected to the bottom of the hollow portion 15 and a spring accommodating chamber 17 formed in the lower part thereof. The insert hole 16 communicates through a passage 18 with the spring accommodating chamber or hole 17.

Threadably engaged with the upper end of the holder body 10 is a cap 19 on which a solenoid 1 is mounted. A cylindrical member 3 is fitted in the space extending from the cap 19 to the aforementioned insert hole 16. Further, the aforementioned hollow portion 15 is closed by the cap 19 to form an accumulator chamber 4.

The pressure accumulator chamber 4 is connected to the delivery side of a fuel injection pump (not shown) through a communication passage in which a check valve 11 is installed. The check valve 11 is fitted to the holder body 10.

A needle valve mechanism "A" is fitted to the lower part of the holder body 10. The needle valve mechanism "A" comprises a nozzle nut 20 which is threadably engaged with the holder body 10 and which supports an intermediate member 21 and a nozzle body 30.

Inserted in the nozzle body 30 is a needle valve 13, the upper end of which is connected to the lower end of a rod or pressure pin 22. The upper end of the rod 22 is provided with a lower spring retainer 23 which is located in the lower part of the spring accommodating chamber 17. Mounted in the uppermost part of the spring accommodating chamber 17 is an upper spring retainer 24. A needle spring 12 is interposed between the upper and lower spring retainers 24 and 23.

The upper spring retainer 24 has a hole 25 formed therein and which connects to the aforementioned passage 18. Further, the passage 18 communicates with a leaked fuel return passage 14.

One end of a passage 8 opens in the portion of the cylindrical member 3 protruding into the insert hole 16, and the other end of the passage 8 communicates with a pressure chamber 26 formed in the nozzle body. The cylindrical member 3 has a passage 6 formed in the lower part thereof which communicates with the pressure accumulator chamber 4.

Slidably mounted inside the aforementioned cylindrical member 3 is a spool valve 2 which is moved downwards by the excitation of the solenoid 1, the lower end of the spool valve 2 projecting downwards of the cylindrical member 3. The downwardly projecting part of the spool valve 2 forms a spring retainer seat 27. Between the spring retainer seat 27 and the insert hole 16, there is interposed a spring 9. The above-mentioned spool valve 2 has a communicating passage 5 formed therein.

Thus, the fuel delivered under pressure by the fuel injection pump is accumulated in the pressure accumulator chamber 4. Upon termination of the delivery of fuel under pressure by the fuel injection pump, the check valve 11 will be shut off. When the spool valve 2 is pushed down by the solenoid 1 which is energized by a controller not shown, the pressurized fuel will pass through the communication passage 5 and the passage 8 and push upwards the needle valve 13 and then is injected through orifices 31 into a combustion chamber not shown.

With the progress of fuel injection, the pressure within the accumulator chamber 4 will decrease, and when it has reached the needle valve closing pressure set by the spring 12, the needle valve 13 will move downward to cut off fuel injection.

As described in detail hereinabove, according the present invention, since the pressure accumulator chamber 4 is self-contained in the holder body, there is no need of specially increasing the moving velocity of the plunger of the fuel injection pump in order to raise the injection pressure, and so a high injection pressure can be obtained while keeping the driving horsepower of the fuel injection system comparatively low. Further, the currently employed jark type fuel injection system is disadvantageous in that there are encountered various difficulties in its use, such as reflection waves and cavitation erosion caused by cavities etc. In the case of present invention, such difficulties can be eliminated by the provision of the pressure accumulator chamber. Since the pressure accumulator chamber and the spool valve are located in the upper part of the nozzle, a fuel injection waveform of approximately rectangular shape can be obtained, thus giving good effect to the combustion of fuel.

Because the fuel injection timing is determined by the solenoid valve, an optimum control can be obtained depending on the revolutional speed, load and the exhaust temperature of the engine associated therewith.

Further, since the currently commercially available parts can be employed as the needle, pressure pin and springs etc., the cost of the fuel injection valve can be kept as low as possible.

It is to be understood that the foregoing description is merely illustrative of a preferred embodiment of the present invention, and that the scope of the invention is not to be limited thereto, but is to be determined by the scope of the appended claims.

What I claim is:

1. A fuel injection apparatus including a fuel injection pump operatively connected therewith, comprising:

a holder body having an accumulator chamber and a spring chamber formed therein at an upper end portion and a lower end portion thereof, respectively;

a nozzle body detachably connected to said holder body, said nozzle body having formed therein a stepped longitudinal bore, a pressure chamber intermediate said stepped longitudinal bore and an injection orifice communicating with said longitudinal bore;

a check valve disposed in a passage communicating said fuel injection pump with said accumulator chamber for allowing the fuel passage from said injection pump to said accumulator chamber but blocking the opposite way;

a solenoid-operated spool valve means mounted in said accumulator chamber, said spool valve means comprising a cylindrical member having an inlet port and an outlet port formed therein and a spool movable in said cylindrical member;

a communication passage formed in said holder and valve bodies, said communication passage having an upper end selectively connectible with said accumulator chamber through said spool valve means and a lower end in constant communication with said pressure chamber;

a needle valve fitted in said stepped longitudinal bore and movable therein in response to fluid pressure developed in said pressure chamber;

a first spring means accommodated in said spring chamber for biasing said needle valve toward closing said injection orifice;

a second spring means for biasing said spool toward a first spool position where communication between said accumulator chamber and said communication passage is blocked; and means formed in said spool for normally blocking communication between said accumulator chamber and said communication passage when said spool is upwardly displaced to the first spool position by said second spring means but allowing communication therebetween when said spool is downwardly displaced to a second spool position by the actuation of said solenoid-operated spool valve means.

2. A fuel injection apparatus as recited in claim 1 further comprising a nozzle nut for detachably connecting said holder body to said nozzle body.

* * * * *

UNITED STATES PATENT OFFICE
CERTIFICATE OF CORRECTION

PATENT NO. : 4,349,152

DATED : September 14, 1982

INVENTOR(S) : Jiro AKAGI

It is certified that error appears in the above-identified patent and that said Letters Patent are hereby corrected as shown below:

The following should be included on the Cover Sheet:

--[30] Foreign Application Priority Date:

October 5, 1979 Japan Utility Model Appln. No. 137,429/79--

Signed and Sealed this

*Fourteenth* Day of *June 1983*

[SEAL]

*Attest:*

DONALD J. QUIGG

*Attesting Officer*

*Acting Commissioner of Patents and Trademarks*